US007438543B2

(12) United States Patent
Beez

(10) Patent No.: US 7,438,543 B2
(45) Date of Patent: Oct. 21, 2008

(54) OSCILLATING SLIDE MACHINE

(76) Inventor: Günther Beez, Ahornstrasse 4, 98666 Masserberg, OT Schnett/Thüringen (DE)

( * ) Notice: Subject to any disclaimer, the term of this patent is extended or adjusted under 35 U.S.C. 154(b) by 448 days.

(21) Appl. No.: 10/547,635

(22) PCT Filed: Nov. 5, 2004

(86) PCT No.: PCT/DE2004/002448

§ 371 (c)(1),
(2), (4) Date: Sep. 1, 2005

(87) PCT Pub. No.: WO2005/047703

PCT Pub. Date: May 26, 2005

(65) Prior Publication Data

US 2006/0191360 A1 Aug. 31, 2006

(30) Foreign Application Priority Data

Nov. 8, 2003 (DE) ..... 103 52 267

(51) Int. Cl.
*F01C 1/10* (2006.01)
*F03C 2/00* (2006.01)

(52) U.S. Cl. ..... 418/172; 418/176; 418/177; 418/241

(58) Field of Classification Search ..... None
See application file for complete search history.

(56) References Cited

U.S. PATENT DOCUMENTS 1,350,159 A * 8/1920 Johnson ..... 418/61.1
1,370,810 A 3/1921 Hansen
1,941,651 A * 1/1934 Behlmer ..... 418/138
1,961,592 A * 6/1934 Muller ..... 418/29
2,778,317 A * 1/1957 Cockburn ..... 418/78
3,703,344 A * 11/1972 Reitter ..... 418/61.1
3,796,525 A * 3/1974 Kilmer ..... 418/61.1
3,821,899 A * 7/1974 Granberg ..... 73/260
3,901,630 A * 8/1975 Kilmer ..... 418/59
4,403,581 A * 9/1983 Rogachevsky ..... 123/239
4,435,138 A * 3/1984 Johnson ..... 418/131
4,538,974 A 9/1985 Stitch
6,481,988 B2 * 11/2002 Valentinovich ..... 418/61.1
6,584,963 B2 * 7/2003 Arnold ..... 123/559.1

(Continued)

FOREIGN PATENT DOCUMENTS

DE 668362 11/1938

(Continued)

OTHER PUBLICATIONS

International Search Report.

(Continued)

*Primary Examiner*—Thomas Denion
*Assistant Examiner*—Douglas J. Duff
(74) *Attorney, Agent, or Firm*—Collard & Roe, P.C.

(57) ABSTRACT

The invention relates to an oscillating slide machine working on an eccentric circulatory motion, whereby the oscillation guide grooves (19) on the inner rotor (5) are provided with groove front edges (20) and groove rear edges (21) of differing heights, such that the diameter of the imaginary circle (17), connecting all groove front edges (20), is smaller than the diameter of the circle connecting all the groove rear edges (21).

5 Claims, 4 Drawing Sheets

U.S. PATENT DOCUMENTS

2001/0046447 A1* 11/2001 Valentinovich ..... 418/61.1

FOREIGN PATENT DOCUMENTS

Figure 1:
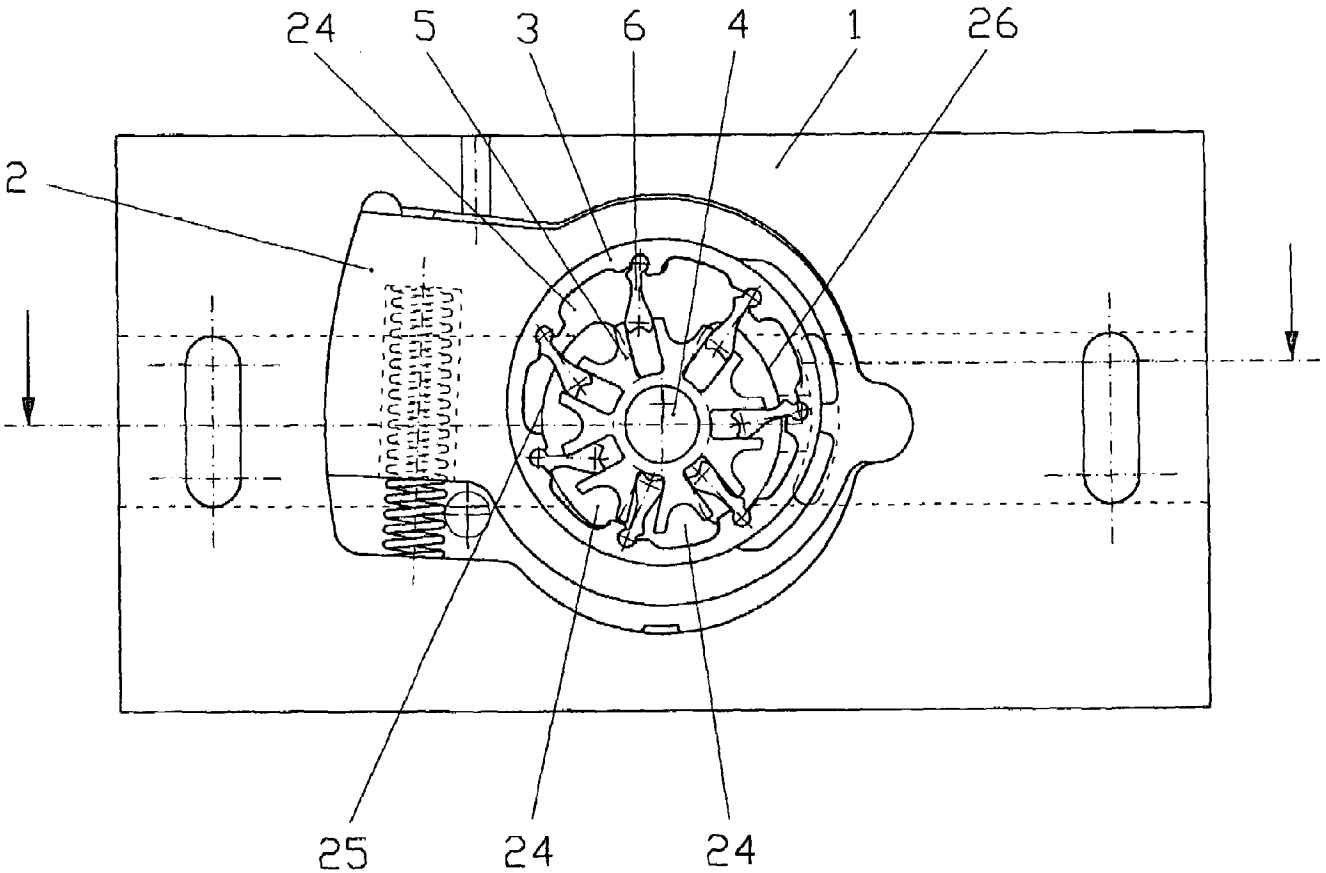

| | | |
|---|---|---|
| DE | 942 314 | 5/1956 |
| DE | 942 314 C | 5/1956 |
| DE | 26 14 602 | 10/1977 |
| DE | 39 13 414 | 10/1990 |
| DE | 44 34 430 | 3/1996 |
| DE | 195 32 703 | 11/1996 |
| DE | 195 32 703 C1 | 11/1996 |
| DE | 101 02 531 | 7/2002 |
| DE | 101 02 531 A1 | 7/2002 |
| EP | 0 601 218 | 6/1994 |
| EP | 1 225 337 | 7/2002 |
| EP | 1 225 337 A2 | 7/2002 |
| FR | 980 766 | 5/1951 |

OTHER PUBLICATIONS

International Search Report.

* cited by examiner

OSCILLATING SLIDE MACHINE

CROSS REFERENCE TO RELATED APPLICATIONS

Applicant claims priority under 35 U.S.C. §119 of German Application No. 103 52 267.0 filed Nov. 8, 2003. Applicant also claims priority under 35 U.S.C. §365 of PCT/DE2004/002448 filed Nov. 5, 2004. The international application under PCT article 21 (2) was not published in English.

The invention relates to a pendulum slide machine that works by means of an eccentric circulatory motion.

In the state of the art, pendulum slide machines having an inner rotor mounted to rotate, and an outer rotor also mounted to rotate, driven by way of a pendulum driver, were already presented in FR 980 766 as well as in DE 195 32 703 C1, in which the transport stream can be varied by means of varying the eccentricity between the inner rotor and the outer rotor. In these constructions, the symmetrically structured pendulum drivers are disposed to pivot in the pans of the outer rotor, which is mounted so as to rotate, with their circular head region, in each instance, and to slide in the grooves of the inner rotor with their conical end that lies opposite the head region.

Synchronous running between the eccentrically running inner rotor as compared with the outer rotor is guaranteed, in these constructions, by way of the play that is permitted between the inner rotor and the pendulum drivers that are disposed to slide in the grooves of the latter.

In order to avoid deformation of the components at a degree of effectiveness that is still reasonable, very low permissible tolerance ranges must be adhered to in production. This results in the very high production costs for such pendulum slide machines.

As a result of the design-related transfer of force from the inner rotor to the outer rotor, by way of the pendulum driver, a tilting moment acts on the pendulum driver, which results in non-uniform running and furthermore causes increased friction losses. In an extreme case, this can lead to jamming of the pendulum in the groove region.

Because of the extreme pressure peaks that occur with these constructions, pulsation of the volume transport stream can furthermore occur and, also, cavitation phenomena can occur in the upper speed of rotation range.

As presented in DE 101 02 531 A1, but also in EP 1 225 337 A2, which claims the priority of DE 101 02 531 A1, it was already considered, years ago, to use non-symmetrical pendulum drivers in connection with a setting device for a cell pump that can be regulated in terms of amount.

However, the practical experiments conducted with such non-symmetrical pendulum drivers showed that these pendulum slide machines equipped with non-symmetrical pendulum drivers (according to FIGS. 1, 5, and 6 of the aforementioned invention specifications) demonstrate such serious disadvantages, such as, for example, a non-uniform torque progression, a strong pulsation (particularly at maximum eccentricity), regulation problems (that are particularly brought about at high speeds of rotation, due to jamming effects), strong traces of wear in the region of the pendulum foot, stability problems in the region of the pendulum stay and, resulting from this, a severe limitation of the cropping angle, as well as a low degree of effectiveness of approximately 5 to 10%, and all of this at extremely high but absolutely necessary production tolerances which, in combination with the non-symmetrical configuration of the pendulum drivers, further clearly increased the very high production costs of the conventional pendulum slide machines, so that as compared with the construction presented in DE 195 32 703 C1, of a pendulum slide machine having symmetrical pendulum drivers, the non-symmetrical pendulum drivers used in such machines do not demonstrate any advantages at all, but rather, on the contrary, result only in disadvantages.

From economic aspects, no effective, functionally reliable long-term operation could therefore be guaranteed with these non-symmetrical pendulum drivers used in the pendulum slide machines of that time, described in DE 101 02 531 A1.

For this reason, the use of such non-symmetrical pendulum drivers was discontinued by the applicant of DE 101 02 531 A1 after production of a small series.

The task of the invention now consists in developing a new type of pendulum slide machine that works by means of an eccentric circulatory movement, which machine eliminates the aforementioned disadvantages of the state of the art and, in combination with the use of non-symmetrical pendulum drivers, clearly improves the running properties, results in a uniform torque progression, clearly lowers pulsation, and furthermore, at the same time, significantly increases the maximal eccentricity as compared with conventional pendulum slide machines, with the same construction size, increases the transport volume, and in this connection avoids the stability problems in the region of the pendulum stay, even when the cropping angle is clearly increased, furthermore results in an optimal transfer of force between the individual parts of the pendulum slide machine in all ranges of speed of rotation, at the same time clearly reduces the tendency to cavitation even in very high ranges of speed of rotation, in this connection improves the regulability, significantly increases the transport effect of the pendulum slide machine, furthermore significantly reduces the wear as a whole, but particularly in the critical region of the pendulum foot, in this connection minimizes the friction losses, furthermore significantly increases the degree of effectiveness, but over and above this, at the same time clearly reduces the production accuracy required for functionally reliable long-term operation, significantly lowers the production costs, and furthermore makes it possible to arrange not only an odd number of pendulum stays (6) (starting from five pendulum stays (6)), but also to arrange an even number of pendulum stays (starting from six pendulum stays (6)).

This task is accomplished by means of a pendulum slide machine having at least one rotor set consisting of an inner rotor (5) disposed on a drive shaft (4), which is connected, by means of pendulum stays (6) provided with pendulum heads (7) and pendulum feet (12), with an outer rotor (3) mounted in the housing (1) directly or indirectly, for example in a control slide (2), so as to rotate, whereby the pendulum stays (6) are structured in such a manner that a pendulum head plate (9) is disposed on the pendulum rear side on the pendulum head, as compared with the connecting line between the center point of the pendulum head circle and the pendulum foot center, which plate is inclined in the direction of the pendulum foot (12), and makes a transition into a pendulum rear side slide-off cam (11) at its free end, approximately at a right angle, whereby the circular pendulum head (7), on the other hand, makes a transition into a pendulum front side slide-off cam (10) that runs all the way to the pendulum foot (12), by way of a pendulum head groove (8). These pendulum stays (6) structured in this manner are disposed, with their pendulum heads (7), in pan grooves (14) uniformly distributed over the circumference of the outer rotor (3), whereby a pendulum accommodation stay (15) is disposed on the front side of the pan groove (14), and an inclined pendulum contact surface (16) is disposed on the rear side of the pan groove (14), and the pendulum stays (6) are disposed in pendulum guide grooves (19) with their pendulum feet (12), which machine is characterized in that the pendulum guide grooves (19) of the inner rotor (5) are provided with groove front edges (20) and groove rear edges (21) having different heights, in such a manner that the imaginary connecting circle diameter (17) of all the groove front edges (20) is smaller than the connecting circle diameter of all the groove rear edges (21).

On the basis of this solution according to the invention, the difference between the connecting circle diameters that is required, in each instance, according to the invention, is established on the basis of the pendulum stay cross-section that is required for the transfer of force and for dynamic stability, and of the "cropping" of the pendulum that is required for an optimal transport.

Because of the height difference according to the invention, it becomes possible, on the one hand, to clearly increase the supporting material thickness of the pendulum stays (6) in the neck region, and at the same time to implement "a greater tilting angle."

In combination with the height difference according to the invention, the rear side slide-off cam (11) of the pendulum is also redefined, so that as a consequence of the arrangement, according to the invention, of groove front edges (20) and groove rear edges (21) having different heights, all of the problems that occurred until now and appeared to be insoluble are brought to an optimal solution, almost at the same time.

Thus, for example, on the basis of these groove front edges (20) and groove rear edges (21) having different heights, elimination of all stability problems in the region of the pendulum stay is achieved, on the one hand, with a simultaneous clear expansion of the cropping angle, and as a result, a uniform torque progression is achieved, and a clear improvement in the running properties, but also a significant reduction in the pulsation, with a simultaneous clear increase in the maximal eccentricity and a reduced tendency to cavitation even in very high ranges of speed of rotation, and this with a simultaneous improvement in the transport effect and a significant improvement in the regulability of the pendulum slide machine, in combination with a clear reduction in the wear as a whole, but particularly in the region of the pendulum foot.

In this connection, the groove rear edges (21), which are higher as compared with the groove front edges (20), allow uniform running at low wear and a high degree of effectiveness, even at maximal eccentricity, in interaction with the other modules according to the invention, so that because of the solution according to the invention, it is possible to assign so much play between the pendulum guide groove (19) and the slide-off cams (of the pendulum stay (6)) assigned, in each instance, even to the pendulum stay (6) disposed in the inner rotor (5), in each instance, that even at maximal eccentricity and very great permissible production tolerances, jamming of these modules with one another is precluded.

In this way, the high production accuracy required for the production of pendulum slide machines (both with and without non-symmetrical pendulums) was significantly reduced, and thereby the production costs of the pendulum slide machines, as a whole, was reduced to a reasonable level, for the first time.

By means of the solution according to the invention, it was furthermore possible, for the first time, to overcome the arrangement of an odd number of pendulum stays (6) (starting from five pendulum stays (6)) that was absolutely necessary for functionally reliable long-term operation of a pendulum slide machine until now, and to guarantee functionally reliable long-term operation even with the arrangement of an even number of pendulum stays (starting from six pendulum stays (6)).

In this connection, it became possible, for the first time, by means of the solution according to the invention, to undertake a dimensioning of the cropped pendulum geometry that simultaneously met the requirements of the actual loads that occur, as well as those of optimal transport, so that an optimal transfer of force between the individual components of the pendulum slide machine became possible in all ranges of speed of rotation, with a clear increase in the maximal eccentricity, as compared with conventional pendulum slide machines having the same construction space, along with a significantly reduced pulsation and tendency to cavitation, at minimized friction losses, clearly improved running properties, and a significantly increased transport volume, with a clear improvement in the degree of effectiveness.

The arrangement of the groove front edges (20) as compared with the groove rear edges (21) of the inner rotor (5), according to the invention, offset in their (imaginary) connecting circle diameters, allows, at the same time, a special configuration of the outer rotor (3), according to the invention, so that in combination with the severely cropped and at the same time very stable configuration of the pendulum stays (6) that becomes possible according to the invention, a direct transfer of force that is displaced towards the "outside," optimally introducing the circumference force from the inner rotor (5) directly by way of the pendulum head (7) into the pan groove (14), can be achieved between these modules, in the drive region.

It is also characteristic that the imaginary connecting circle diameter (17) of all the pendulum accommodation stays (15) lies clearly within the other inner contour of the outer rotor (3), and that an outer rotor groove (18) is disposed between each pendulum contact surface (16) and the pendulum accommodation stay (15) of the adjacent pendulum (6), in each instance.

It is furthermore according to the invention that an inner rotor groove (23) is disposed between the groove rear edge (21) and the groove front edge (20) of the next pendulum guide groove (19), in each instance.

It is furthermore essential to the invention that the pendulum front side slide-off cam (10) is connected with the pendulum rear side slide-off cam (11) in the region of the pendulum foot (12), by way of a pendulum foot groove (13).

The pump chambers (24) specially configured by means of the arrangement of outer rotor grooves (18) and inner rotor grooves (23), in combination with the pump chamber specially configured by means of the pendulum foot groove (13) also below the pendulum stay (6), have the result, in interaction with the other characteristics of the solution according to the invention, of a further clear reduction in pulsation, as well as cavitation-free filling at very high speeds of rotation, even in the range of maximum eccentricity, so that even very high volume streams can be optimally transported by means of the solution according to the invention.

The pendulum foot groove (13) stabilizes and at the same time guides the pendulum stay (6) during the entire movement sequence, in the pendulum guide groove (19) filled with transport medium, and thereby helps to prevent jamming of a pendulum stay (6) in the pendulum guide groove (19) even if it is subject to very great production tolerances, and thereby at the same time also minimizes the friction losses in the pendulum guide groove (19).

It is also essential to the invention that the pendulum head plate (9) disposed on the pendulum rear side of the pendulum stays (6) on the pendulum head is disposed to be inclined at an angle α of 40° to 55° in the direction of the pendulum foot (12), relative to the connecting line between the center point of the pendulum head circle and the pendulum foot center, whereby the circular pendulum head (7) encloses an angle β of 280° to 310° between the contact line with the pendulum head plate (9) and a pendulum head groove (8) disposed on the pendulum front side.

The totality of this arrangement according to the invention then results in an optimized solution of the task set according to the invention.

Further details and characteristics of the invention are evident from the following description of the exemplary embodiment according to the invention, in combination with the claims as well as the drawings relating to the solution according to the invention.

In the following, the invention will now be explained in greater detail, using an exemplary embodiment, in combination with four figures.

Figure 2:
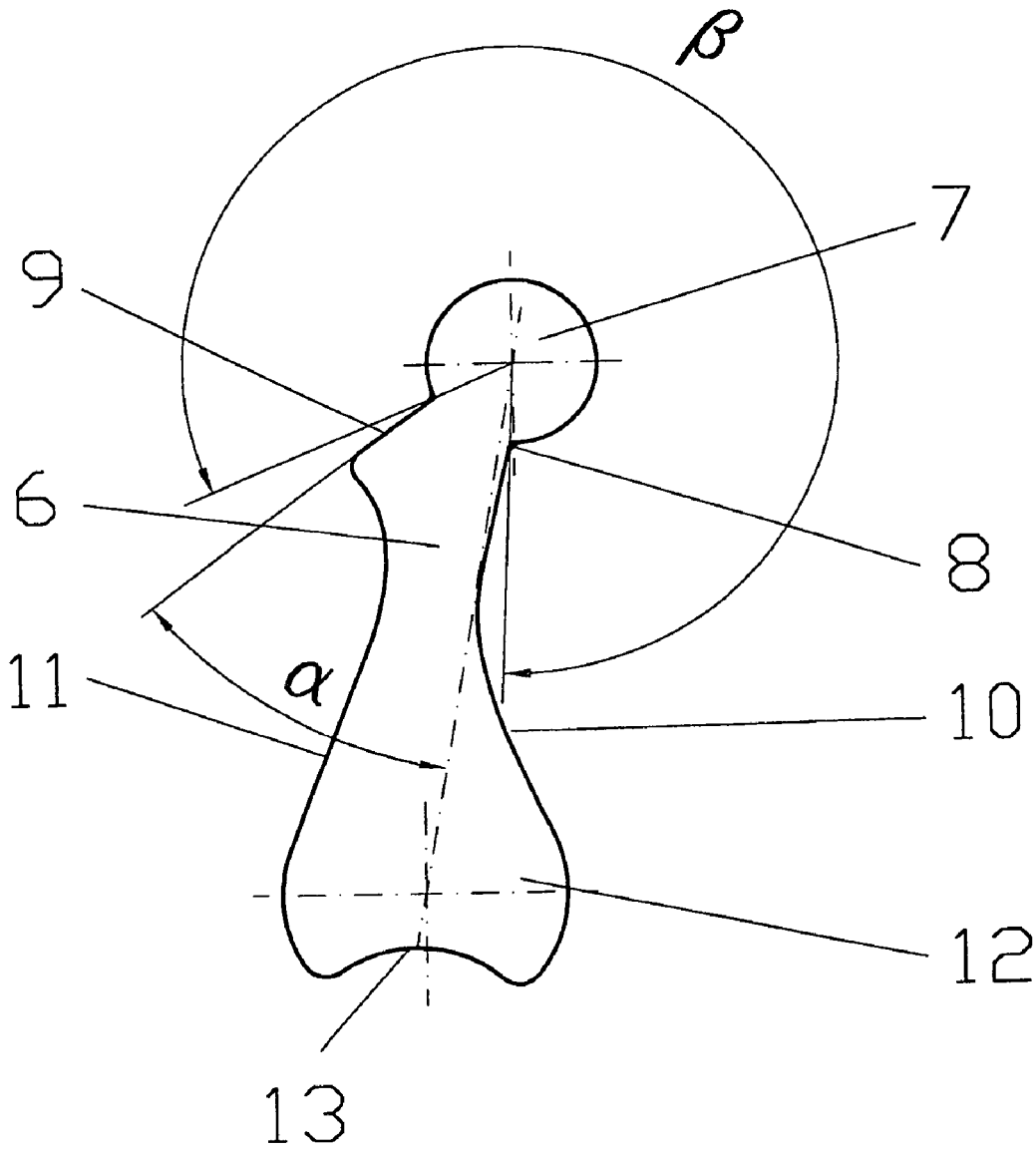
Figure 3:
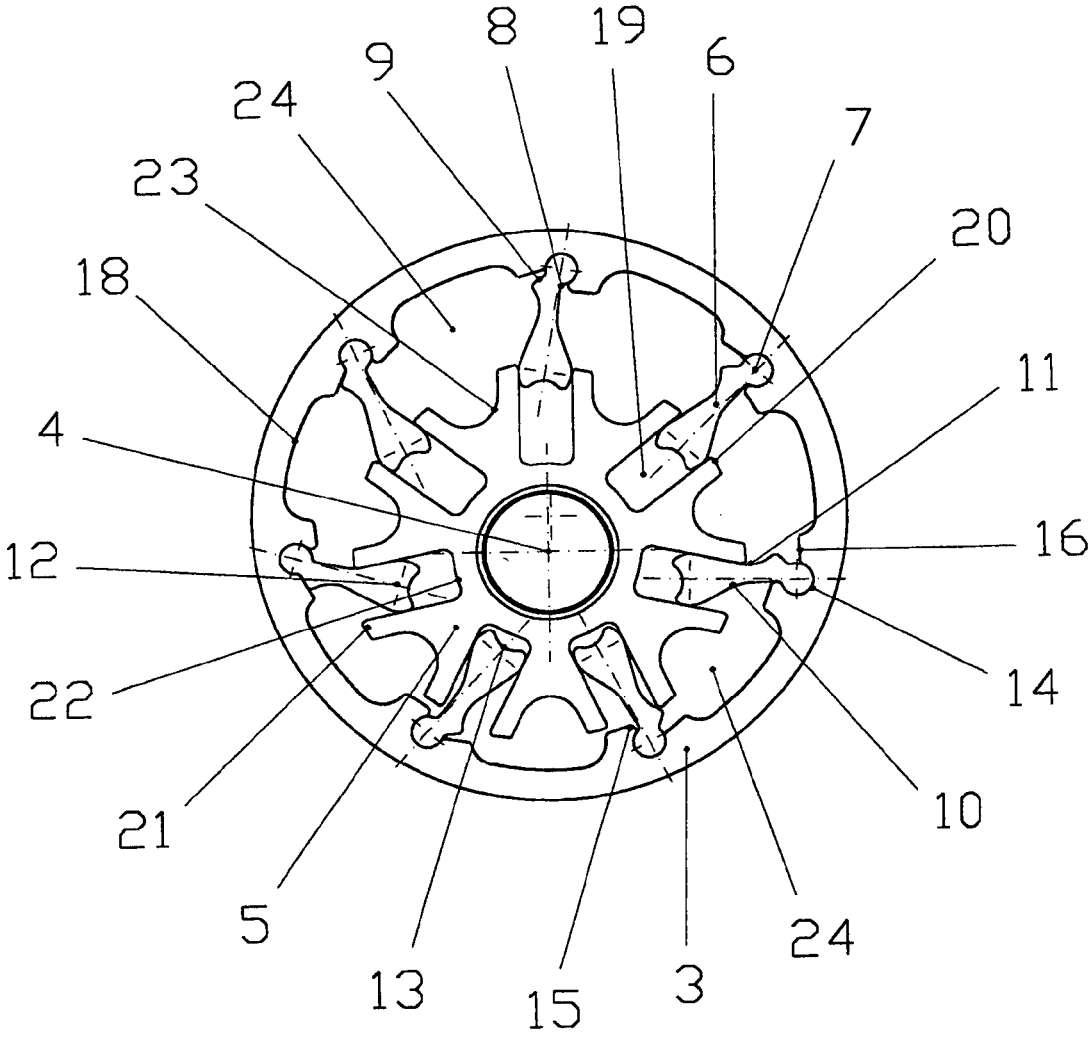
Figure 5:
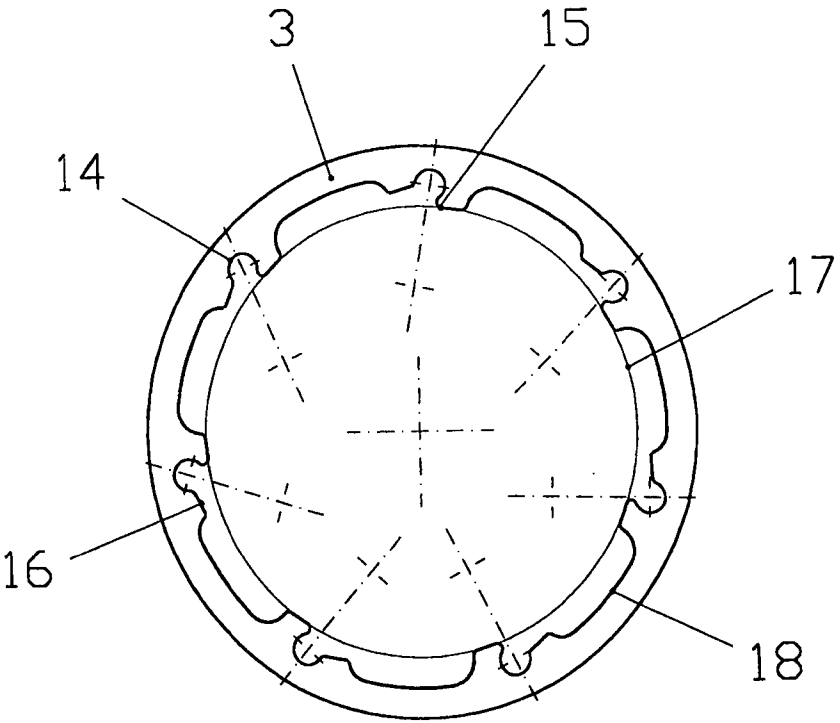
Figure 4:
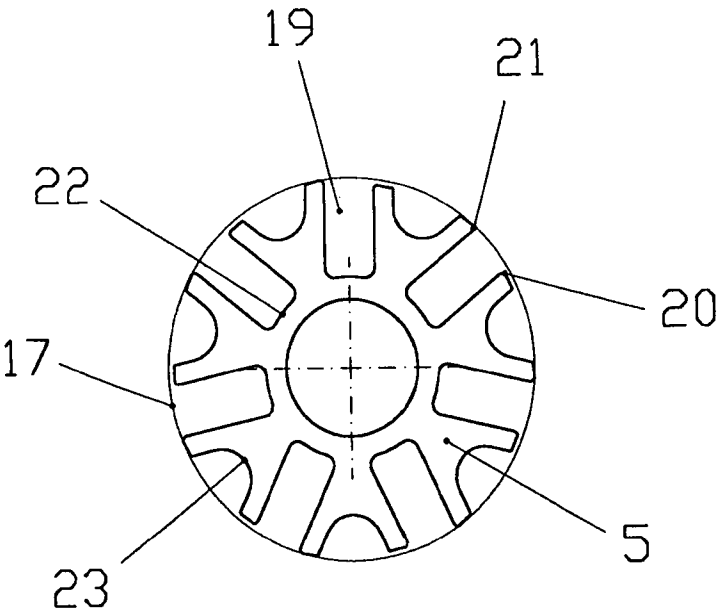

The figures show:

FIG. 1: a possible embodiment of the pendulum slide machine according to the invention, in a side view, in cross-section;

FIG. 2: a side view of a pendulum stay inserted according to the invention;

FIG. 3: a detail view of a rotor set of the pendulum slide machine according to FIG. 1, according to the invention, in a side view;

FIG. 4: the inner rotor of the pendulum slide machine according to the invention, according to FIG. 1, in a side view;

FIG. 5: the outer rotor of the pendulum slide machine according to the invention, according to FIG. 1, in a side view.

FIG. 1 shows one of the possible embodiments of the pendulum slide machine according to the invention, in a side view, in cross-section.

A control slide 2 is disposed in a housing 1. The outer rotor 3 of a rotor set is disposed in this slide, so as to rotate. This rotor set consists of an inner rotor 5 disposed on a drive shaft 4, which is connected with the outer rotor 3, so as to rotate, by way of seven pendulum stays 6.

The individual chamber volumes of the pump chambers 24 formed between the adjacent pendulum stays 6, the outer rotor 3, and the inner rotor 5, in each instance, are brought to a maximal volume, one after the other, and immediately afterwards, to a minimal volume (or vice versa), at each revolution of the drive shaft 4.

When the volume of the pump chambers 11 increases, the medium to be transported is drawn into the pump chambers 24 by way of the suction kidney(s) 25 disposed in the housing 1 and/or in the housing lid.

At the same time, a volume reduction of the pump chambers 24 takes place in the direction of rotation of the drive shaft 4, offset by 180°, as a result of the eccentricity between the inner rotor 5 and the outer rotor 3, so that there, the medium to be transported exits from the pump chambers 11 by way of the pressure kidney(s) 26 disposed on the housing 1 and/or in the housing lid.

The pendulum stay 6 according to the invention shown in FIG. 2 is structured in such a manner that a pendulum head plate 9 inclined at an angle α of 43° in the direction of the pendulum foot 12 is disposed on the pendulum rear side on the pendulum head 7, as compared with the connecting line between the center point of the pendulum head circle 7 and the center of the pendulum foot 12.

This plate makes a transition into a pendulum rear side slide-off cam 11 at its free end, at approximately a right angle.

The circular pendulum head 7 sweeps an angle β of 296° between the contact line with the pendulum head plate 9 and a pendulum head groove 8 disposed on the pendulum front side.

The circular pendulum head 7 makes a transition into a pendulum front side slide-off cam 10 that runs all the way to the pendulum foot 12, by way of this pendulum head groove 8.

The pendulum front side slide-off cam 10 is connected with the pendulum rear side slide-off cam 11 by means of a pendulum foot groove 13, in the region of the pendulum foot 12.

FIG. 3 shows a detailed representation of the rotor set of the pendulum slide machine structured according to the invention, according to FIG. 1, in a side view. The seven pendulum stays 6 are disposed with their pendulum heads 7 in pan grooves 14 distributed uniformly over the circumference of the outer rotor 3. On the front side of the pan groove 14, there is a pendulum accommodation stay 15, in each instance, and on the rear side of each pan groove 14, there is an inclined pendulum contact surface 16 that makes a transition into the outer rotor groove 18. An outer rotor groove 18 is disposed between each pendulum contact surface 16 and the next pendulum accommodation stay 15, in each instance.

The pendulum stays 6 are disposed in the pendulum guide grooves 19 of the inner rotor 5 with their pendulum feet 12.

FIG. 4 shows the inner rotor 5 of the pendulum slide machine according to the invention, according to FIGS. 1 and 3, in a side view, with the pendulum guide grooves 19.

It is essential, in this connection, that the pendulum guide grooves 19, as shown in FIG. 4, are provided with groove front edges 20 and groove rear edges 21 that have different heights.

In this connection, the imaginary connecting circle diameter of all the groove front edges 20 is always smaller than the connecting circle diameter 17 of all the groove rear edges 21. An inner rotor groove 23 is disposed between each groove rear edge 21 and the next groove front edge 20, in each instance.

In FIG. 5, the outer rotor 5 of the pendulum slide machine according to the invention, according to FIG. 1, is shown in a side view.

As is evident from this representation, the connecting circle diameter 17 of all the pendulum accommodation stays 15 clearly lies within the other inside contour of the outer rotor 3.

In the case of maximal eccentricity, as shown in FIGS. 1 and 3, the solution according to the invention, as presented here, first has the effect, in the lower range of speed of rotation, that at the beginning of the "drive region," the groove rear edge 21 rests against the pendulum rear edge slide-off cam 11 with its lower region, and then moves along the pendulum rear side slide-off cam 11 over the entire "drive region," in such a manner that in this connection, the pendulum stay 6 dips into the pendulum guide groove 19 of the inner rotor 5, until the transition region from the pendulum rear side slide-off cam 11 to the pendulum head plate 9 rests against the groove rear edge 21 of the inner rotor, which is disposed to be elevated.

In all phases of this movement sequence in the "drive region," the pendulum head groove 8 of the pendulum stay 6 rests almost against the pendulum accommodation stay 15 of the outer rotor 3, and in this end position guarantees an optimal transfer of force, because of its positive-lock positioning.

During this movement sequence as just described, the "dipping process," the solution presented here has the result that the line of effect of the radial shear force acting on the pendulum stay 6, in each instance, always engages on the pendulum stay 6 within the pendulum guide groove region, so that even at very great eccentricity and high operating pressures, optimal guide of the pendulum stay 6 with "cantilevered gripping" is always guaranteed, in combination with the arrangement of a pendulum foot groove 13 on the pendulum foot 12, thereby precluding tilting or wedging of the pendulum stays 6 in the pendulum guide groove 19.

The pendulum foot groove 13 disposed on the pendulum foot 12 also has the effect, in this connection, that the medium located under the pendulum foot groove 13, to be transported by the pendulum foot 12, can be optimally displaced during the transport process, while avoiding pressure peaks.

With an increasing speed of rotation, the outer rotor 3 starts to run ahead of the inner rotor 5, starting from a speed of rotation that is dependent on the design, construction, and the eccentricity, in each instance, as a result of the configuration of the pendulum guide grooves (19) of the inner rotor (5), according to the invention, the configuration of the pendulum stays 6 that is related to it, as well as the configuration of the outer rotor 3 that is connected with the configuration of the pendulum guide grooves (19) of the inner rotor 5, according to the invention (as a result of the centrifugal forces that occur, in combination with the pressure that builds up in the pendulum guide groove 19).

This operating state, which surprisingly always occurs with the construction according to the invention, and was not to be expected in any way, results in a significant reduction of the required drive power, while the transport volume stream remains the same, and thereby surprisingly contributes to an additional further very significant increase in the degree of effectiveness. In this very optimal state of "running ahead," the "lowered" groove front edge 20, according to the invention, rests against the pendulum front side slide-off cam 10 and guarantees synchronous running, because of the construction according to the invention, up to very high ranges of speed of rotation, with optimized power transfer properties.

At almost centric running, on the other hand, all of the pendulum stays 6 move into an almost similar position, which necessarily would have to result in jamming of the pendulum stays 6 in the pendulum guide grooves 19, in each instance.

As a result of the configuration of the pendulum guide groove regions according to the invention, in combination with the special configuration of the pendulum stays 6 that becomes possible thereby, with the pendulum head plates 9 disposed on these stays, as well as the pendulum contact surfaces 16 assigned in each instance, disposed on the outer rotor, it is guaranteed by the solution according to the invention, even at almost centric running, that the pendulum stays 6 do not jam in the assigned pendulum guide grooves 19.

The pump chambers 24 specially configured by the outer rotor grooves 18 and the inner rotor grooves 23 have the effect, at the same time, in combination with an increase in the filling cross-section, in each instance, even at very high speeds of rotation and very high transport volume streams, of pulsation-free and cavitation-free filling and emptying at all times.

Using the solution according to the invention, it has therefore been possible to develop a new type of pendulum slide machine that works by means of an eccentric circulatory movement which, in combination with the use of non-symmetrical pendulum drivers, clearly improves the running properties, brings about a uniform torque progression, clearly lowers the pulsation, and furthermore, at the same time, significantly increases the maximal eccentricity as compared with conventional pendulum slide machines having the same construction space, increases the transport volume, avoids the stability problems in the region of the pendulum stay even in case of a clear expansion of the cropping angle, furthermore brings about an optimal transfer of force between the individual components of the pendulum slide machine in all ranges of speed of rotation, at the same time clearly reduces the tendency to cavitation even in very high ranges of speed of rotation, significantly increases the transport effect of the pendulum slide machine, furthermore significantly reduces the wear as a whole, but particularly in the critical region of the pendulum foot, at the same time minimizes the friction losses, furthermore significantly increases the degree of effectiveness, beyond this at the same time clearly reduces the production accuracy required for functionally reliable long-term operation, at the same time significantly reduces the production costs, and furthermore makes possible not only the arrangement of an odd number of pendulum stays (6) (starting from five pendulum stays (6)), but also the arrangement of an even number of pendulum stays (starting from six pendulum stays (6)).

REFERENCE SYMBOL LIST

1 housing
2 control slide
3 outer rotor
4 drive shaft
5 inner rotor
6 pendulum stay
7 pendulum head
8 pendulum head groove
9 pendulum head plate
10 pendulum front side slide-off cam
11 pendulum rear side slide-off cam
12 pendulum foot
13 pendulum foot groove
14 pan grooves
15 pendulum accommodation stay
16 pendulum contact surface
17 connecting circle
18 outer rotor groove
19 pendulum guide groove
20 groove front edge
21 groove rear edge
22 groove base
23 inner rotor groove
24 pump chamber
25 suction kidney
26 pressure kidney

The invention claimed is:

1. An oscillating slide machine comprising:

(a) a housing;

(b) at least one set of rotors comprising an inner rotor disposed on a drive shaft and an outer rotor pivotally mounted directly or indirectly to the housing;

(c) a plurality of moving bars connecting the inner rotor to the outer rotor, each moving bar comprising a moving head having a front side and a rear side, a moving foot, and a moving head plate disposed on the rear side of the moving head so that the moving head plate tilts toward the moving foot in comparison to a connection line between a center point of a circle formed by the moving head and a center of the moving foot and changes over at a free end of the moving head plate approximately at a right angle to form a rear side slide-off cam and the moving head on the front side changes over by traveling down a moving head groove to the moving foot to form a front side slide-off cam;

(d) a plurality of seating slots uniformly distributed circumferentially over the outer rotor, each seating slot receiving a moving head of a respective moving bar;

(e) a plurality of moving flange holders, each moving flange holder being disposed on a front side of a respective seating slot;

(f) a plurality of tilted moving contact surfaces, each tilted contact surface being disposed on a rear side of a respective seating slot; and (g) a plurality of moving guide slots provided in the inner rotor, each moving guide slot receiving a moving foot of a respective moving bar;

wherein the moving guide slots are provided with front edge grooves and rear edge grooves of differing heights so that an intended diameter of a first circumference of a first connection of all front edge grooves is smaller than a diameter of a second circumference of a second connection of all rear edge grooves.

2. The oscillating slide machine according to claim 1, wherein an imaginary connecting circle diameter of all the moving flange holders lies clearly within an inner edge of the outer rotor, and wherein a respective outer rotor groove is disposed between each tilted moving contact surface and a moving flange holder of an adjacent moving bar.

3. The oscillating slide machine according to claim 1, wherein a respective inner rotor groove is disposed between each rear edge groove and a front edge groove of a following moving guide slot.

4. The oscillating slide machine according to claim 1, wherein each moving head plate disposed on the moving head at the rear side of the respective moving bar is tilted toward the moving foot in relation to the connection line between the center point of the circle formed by the moving head and the center of the moving foot to form an angle $\alpha$ of 40 degrees to 55 degrees, whereby the moving head forms an angle $\beta$ of 280 degrees to 310 degrees between the moving head plate and a moving head groove disposed on the front side of the moving bar.

5. The oscillating slide machine according to claim 4, wherein the front side slide-off cam is connected with the rear side slide-off cam near the moving foot by way of a moving foot groove.

* * * * *